US009617678B2

(12) United States Patent
Yu et al.

(10) Patent No.: US 9,617,678 B2
(45) Date of Patent: Apr. 11, 2017

(54) IMPELLER HOUSING FOR AN APPLIANCE

(71) Applicant: General Electric Company, Schenectady, NY (US)

(72) Inventors: Zhiquan Yu, Mason, OH (US); Joseph Lee McLain, Crestwood, KY (US); Christopher Edward O'Malley, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 44 days.

(21) Appl. No.: 14/522,621

(22) Filed: Oct. 24, 2014

(65) Prior Publication Data

US 2016/0115637 A1 Apr. 28, 2016

(51) Int. Cl.
*D06F 58/20* (2006.01)

(52) U.S. Cl.
CPC ..... *D06F 58/20* (2013.01)

(58) Field of Classification Search
CPC ..... F26B 19/00; F26B 21/00; F26B 21/06; D06F 58/00; D06F 58/12; D06F 58/20; F04D 29/282; F04D 29/666
USPC ..... 34/595, 601, 606, 610; 68/5 C, 5 R, 19, 68/20; 8/139, 149, 159; 416/186 R, 416/241 A
See application file for complete search history.

(56) References Cited

U.S. PATENT DOCUMENTS 2,456,488 A * 12/1948 Brown ..... F04D 29/4226 220/4.02
4,065,233 A * 12/1977 Torigoe ..... F04D 29/441 415/208.3
4,360,977 A * 11/1982 Frohbieter ..... D06F 58/20 165/7
4,700,492 A * 10/1987 Werner ..... D06F 58/22 34/403
5,555,647 A * 9/1996 Torborg ..... D06F 58/08 34/601
5,899,005 A * 5/1999 Chen ..... D06F 58/02 34/528
7,001,149 B1 * 2/2006 Waggoner ..... F04D 29/601 415/204
7,644,516 B2 1/2010 Chung
7,765,716 B2 * 8/2010 Kim ..... D06F 58/04 134/1
7,780,423 B2 * 8/2010 Liang ..... F04D 25/082 417/423.15
7,861,708 B1 * 1/2011 Lyons ..... F04D 25/08 126/104 A
7,992,322 B2 * 8/2011 Kim ..... D06F 58/04 126/85 B (Continued)

FOREIGN PATENT DOCUMENTS

GB 1416882 A * 12/1975 ..... D06F 58/02
JP 2005240766 A * 9/2005

*Primary Examiner* — Stephen M Gravini
(74) *Attorney, Agent, or Firm* — Dority & Manning, P.A.

(57) ABSTRACT

A housing for receiving an impeller is provided. The housing includes a transition duct that extends between a volute of the housing and an exhaust exit of the housing. The transition duct defines a bend between the volute of the housing and the exhaust exit of the housing. Cross-sections of the transition duct upstream and downstream of the transition duct define a substantially rectilinear shape. A related dryer appliance is also provided.

10 Claims, 6 Drawing Sheets

(56) References Cited

U.S. PATENT DOCUMENTS

| | | | | |
|---|---|---|---|---|
| 8,020,316 | B2 * | 9/2011 | Nawrot | D06F 58/04 134/6 |
| 8,051,578 | B2 * | 11/2011 | Kohlrusch | D06F 58/20 264/310 |
| 8,261,466 | B2 * | 9/2012 | Latack | D06F 58/04 34/601 |
| 9,057,153 | B2 * | 6/2015 | Yu | D06F 58/10 |
| 9,121,128 | B2 * | 9/2015 | Hong | D06F 58/02 |
| 9,243,844 | B2 * | 1/2016 | Yu | F26B 21/004 |
| 2016/0090682 | A1 * | 3/2016 | McLain | D06F 58/04 34/139 |
| 2016/0115637 | A1 * | 4/2016 | Yu | D06F 58/04 34/601 |

* cited by examiner

IMPELLER HOUSING FOR AN APPLIANCE

FIELD OF THE INVENTION

The present subject matter relates generally to impeller housings for appliances, such as dryer appliances.

BACKGROUND OF THE INVENTION

Dryer appliances generally include a cabinet with a drum rotatably mounted therein. A motor can selectively rotate the drum during operation of the dryer appliance, e.g., to tumble articles located within a chamber defined by the drum. Dryer appliances also generally include a heater assembly that passes heated air through the chamber of the drum in order to dry moisture laden articles disposed within the chamber.

To circulate heated air, certain dryer appliances include an impeller positioned within a housing. During operation of the dryer appliance, the impeller urges a flow of heated air into the chamber of the drum. Such heated air absorbs moisture from articles disposed within the chamber. The impeller also urges moisture laden air out of the chamber through a vent. The vent can be connected to household ductwork that directs the moisture laden air outdoors.

Performance of a dryer appliance can be affected by the flow of heated air. For example, dryer appliance performance can be improved by generating a large volume of heated air. Conversely, dryer appliance performance can be negatively affected if the heating assembly generates a low volume of heated air.

To improve dryer performance, a size of the impeller can be increased. However, space with a dryer appliance is generally limited or constrained. Thus, increasing a size of the impeller can be difficult. To improve dryer performance, certain dryer appliances include a second motor configured to rotate the impeller. However, motors can be expensive, and adding the second motor to the dryer appliance can increase the cost of the dryer appliance.

Accordingly, a dryer appliance with features for improving air flow through the dryer appliance would be useful. In particular, a dryer appliance with features for improving air flow through the dryer appliance without requiring a relatively large impeller or adding a second motor to the dryer appliance would be useful.

BRIEF DESCRIPTION OF THE INVENTION

Aspects and advantages of the invention will be set forth in part in the following description, or may be apparent from the description, or may be learned through practice of the invention.

In a first exemplary embodiment, a dryer appliance is provided. The dryer appliance includes a cabinet defining a vent and a drum rotatably mounted within the cabinet. The drum defines a chamber for receipt of articles for drying. The dryer appliance also includes an exhaust duct, a motor, and an impeller in mechanical communication with the motor. The impeller is rotatable with the motor in order to urge a flow of air from the chamber of the drum to the vent of the cabinet. The dryer appliance also includes a housing positioned within the cabinet. The housing includes a volute. The impeller is positioned within the housing at the volute of the housing. The housing also includes an exhaust exit. The exhaust duct extends between the exhaust exit of the housing and the vent of the cabinet. The housing also includes a transition duct extending between the volute and the exhaust exit. The transition duct defines a bend and has a first cross-section positioned upstream of the bend and a second cross-section positioned downstream of the bend. The first cross-section and the second cross-section each define a substantially rectilinear shape.

In a second exemplary embodiment, a housing for an impeller of a dryer appliance is provided. The housing includes a cylindrical portion configured for receiving the impeller. The cylindrical portion has a volute. The housing also includes a transition duct extending between the volute and an exhaust exit. The transition duct defines a bend and has a first cross-section and a second cross-section. The first cross-section is positioned upstream of the bend and the second cross-section positioned downstream of the bend. The first cross-section and the second cross-section each define a substantially rectilinear shape.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
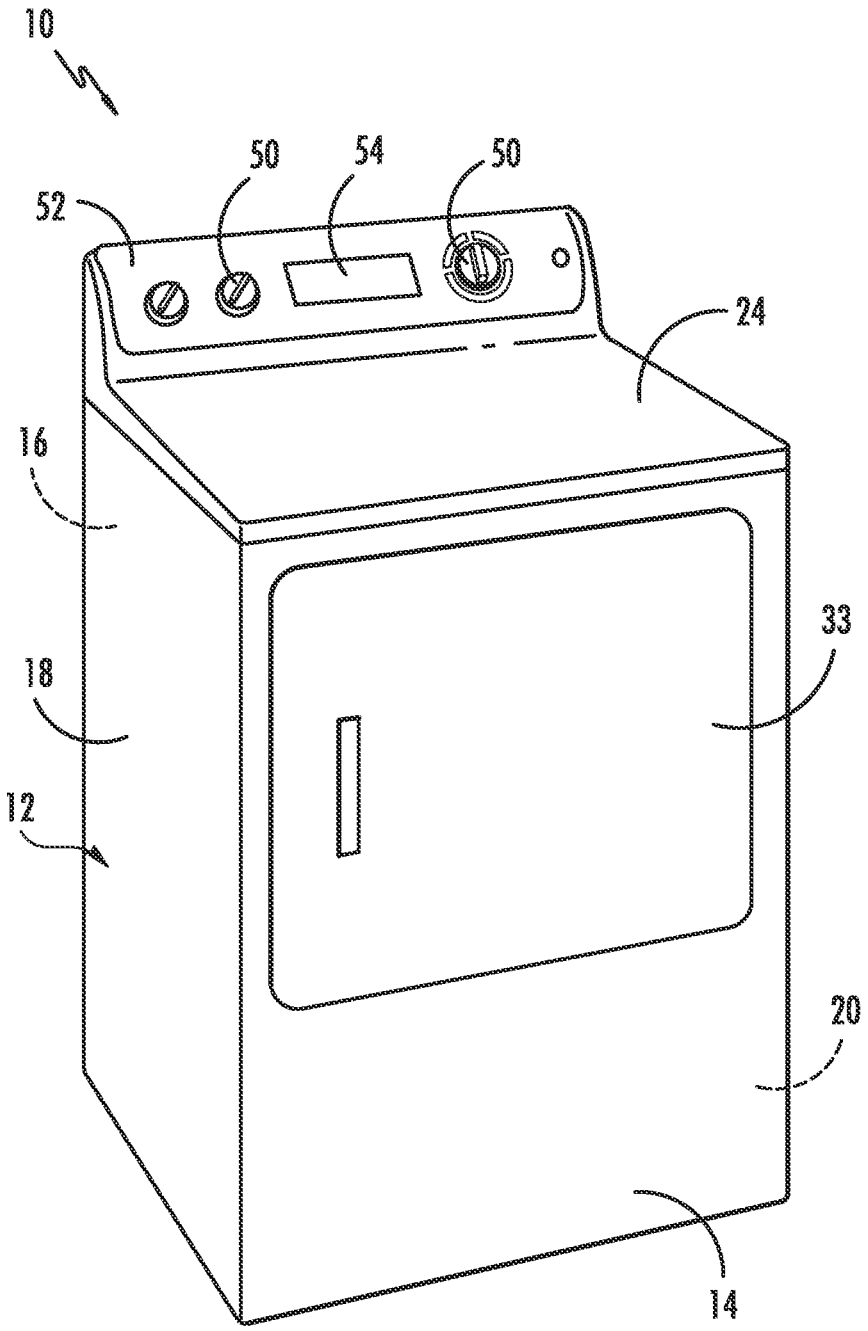
FIG. 1 provides a perspective view of a dryer appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment.

Thus, it is intended that the present invention covers such modifications and variations as come within the scope of the appended claims and their equivalents.

As used herein, the term "article" may refer to, but need not be limited to, fabrics, textiles, garments (or clothing), and linens. Furthermore, the term "load" or "laundry load" refers to the combination of articles that may be washed together in a washing machine or dried together in a laundry dryer (i.e., a clothes dryer) and may include a mixture of different or similar articles of different or similar types and kinds of fabrics, textiles, garments and linens within a particular laundering process.

Figure 2:
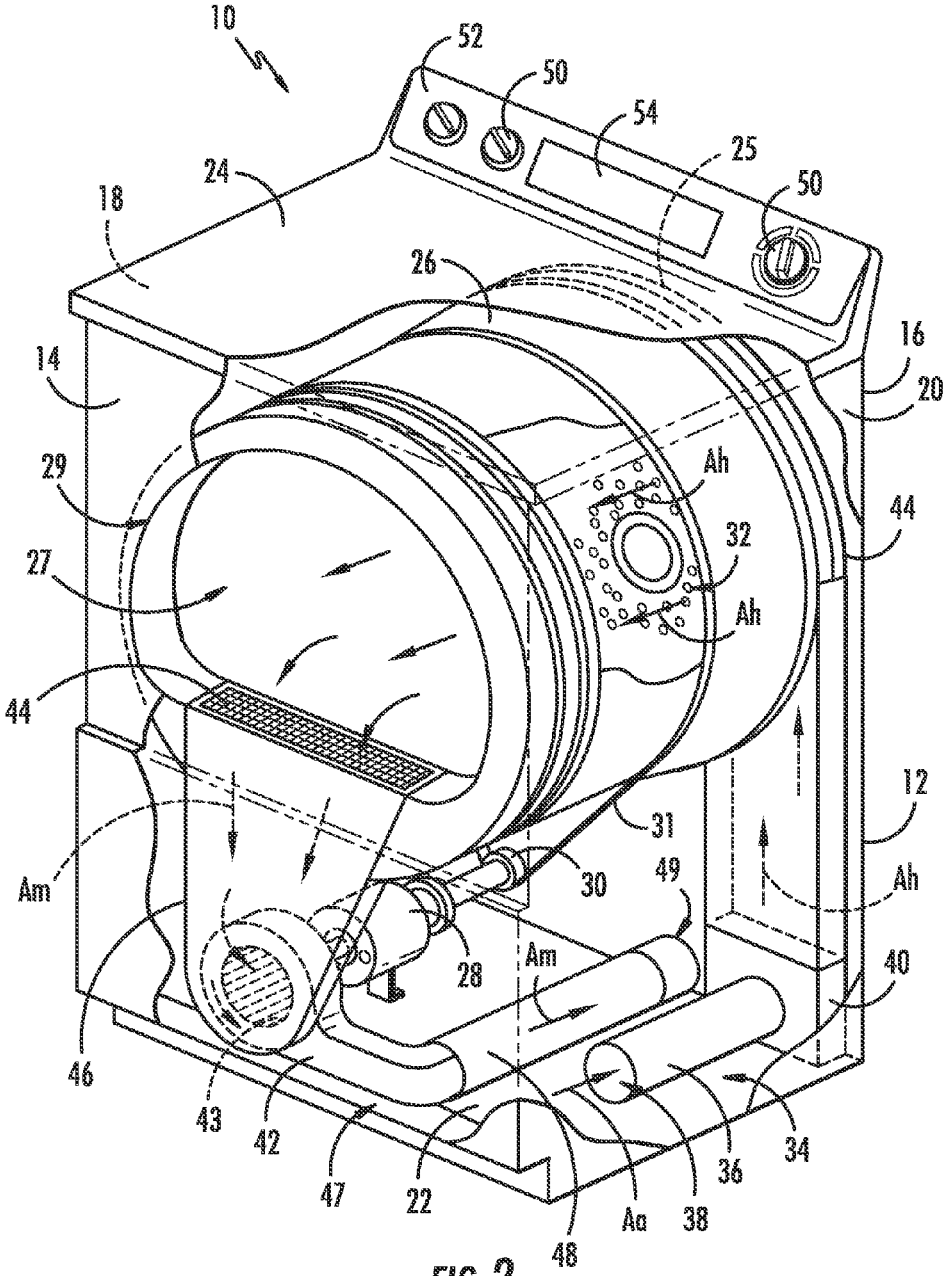
FIG. 2 provides a perspective view of the exemplary dryer appliance of FIG. 1 with a portion of a cabinet of the exemplary dryer appliance removed to reveal certain internal components of the exemplary dryer appliance.

FIGS. 1 and 2 illustrate a dryer appliance 10 according to an exemplary embodiment of the present subject matter. While described in the context of a specific embodiment of dryer appliance 10, using the teachings disclosed herein it will be understood that dryer appliance 10 is provided by way of example only. Other dryer appliances having different appearances and different features may also be utilized with the present subject matter as well. For example, dryer appliance 10 illustrated in FIGS. 1 and 2 is a gas dryer appliance with a combustion chamber 36. In alternative exemplary embodiments, dryer appliance 10 may be an electric dryer appliance with electric heating elements replacing combustion chamber 36, or alternatively may be a heat pump dryer appliance.

Dryer appliance 10 includes a cabinet 12 having a front panel 14, a rear panel 16, a pair of side panels 18 and 20 spaced apart from each other by front and rear panels 14 and 16, a bottom panel 22 (FIG. 2), and a top cover 24. Within cabinet 12 is a drum or container 26 mounted for rotation about a substantially horizontal axis. Drum 26 is generally cylindrical in shape and defines a chamber 27 for receipt of articles for drying.

Drum 26 also defines an opening 29 for permitting access to the chamber 27 of drum 26. Opening 29 of drum 26, e.g., permits loading and unloading of clothing articles and other fabrics from chamber 27 of drum 26. A door 33 is rotatably mounted at opening 29 and selectively hinders access to chamber 27 of drum 26 through opening 29.

Drum 26 includes a rear wall 25 rotatably supported within cabinet 12 by a suitable fixed bearing. Rear wall 25 can be fixed or can be rotatable. A motor 28 rotates the drum 26 about the horizontal axis through a pulley 30 and a belt 31. Motor 28 is also in mechanical communication with a fan or air handler 42 such that motor 28 rotates an impeller 43, e.g., a centrifugal impeller, of air handler 42. Air handler 42 is configured for drawing air through chamber 27 of drum 26, e.g., in order to dry articles located therein as discussed in greater detail below. In alternative exemplary embodiments, dryer appliance 10 may include an additional motor (not shown) for rotating impeller 43 of air handler 42 independently of drum 26.

Drum 26 is configured to receive heated air that has been heated by a heater assembly 34, e.g., in order to dry damp articles disposed within chamber 27 of drum 26. Heater assembly 34 includes a combustion chamber 36. As discussed above, during operation of dryer appliance 10, motor 28 rotates drum 26 and impeller 43 of air handler 42 such that air handler 42 draws air through chamber 27 of drum 26 when motor 28 rotates impeller 43. In particular, ambient air, shown with arrow $A_a$, enters combustion chamber 36 via an inlet 38 due to air handler 42 urging such ambient air $A_a$ into inlet 38. Such ambient air $A_a$ is heated within combustion chamber 36 and exits combustion chamber 36 as heated air, shown with arrow $A_h$. Air handler 42 draws such heated air $A_h$ through a back duct 40 to drum 26. The heated air $A_h$ enters drum 26 through a plurality of holes 32 defined in rear wall 25 of drum 26.

Within chamber 27, the heated air $A_h$ can accumulates moisture, e.g., from damp articles disposed within chamber 27. In turn, air handler 42 draws moisture laden air, shown as arrow $A_m$, through a screen filter 44 which traps lint particles. Such moisture laden air $A_m$ then enters a front duct 46 and is passed through air handler 42 to an exhaust duct 48. From exhaust duct 48, such moisture laden air $A_m$ passes out of clothes dryer 10 through a vent 49 defined by cabinet 12.

Front duct 46 and exhaust duct 48 form a conduit 47 that extends between and connects chamber 27 of drum 26 and vent 49. Conduit 47 places chamber 27 of drum 26 and vent 49 in fluid communication in order to permit moisture laden air $A_m$ to exit dryer appliance 10. Air handler 42 is in fluid communication with conduit 47, and impeller 43 of air handler 42 is positioned within conduit 47.

A cycle selector knob 50 is mounted on a cabinet backsplash 52 and is in communication with a controller 54. Signals generated in controller 54 operate motor 28 and heater assembly 34 in response to a position of selector knob 50. Alternatively, a touch screen type interface may be provided. As used herein, "processing device" or "controller" may refer to one or more microprocessors or semiconductor devices and is not restricted necessarily to a single element. The processing device can be programmed to operate dryer appliance 10. The processing device may include, or be associated with, one or more memory elements such as, e.g., electrically erasable, programmable read only memory (EEPROM).

As stated, however, the exemplary dryer appliance 10 described above with reference to FIGS. 1 and 2 is provided by way of example only, and in other exemplary embodiments, the other suitable dryer appliance may be provided.

Figure 3:
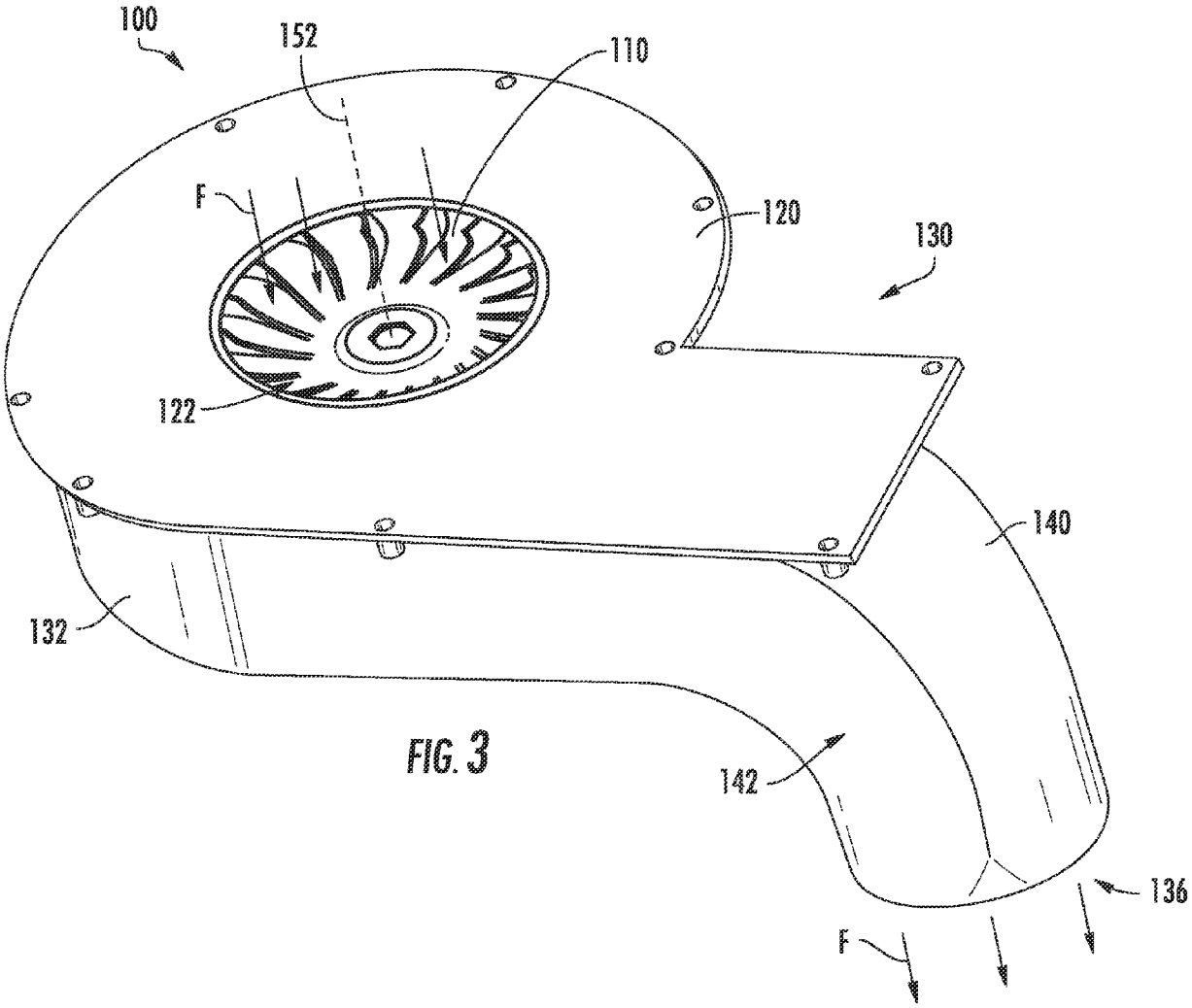
FIG. 3 provides a perspective view of an impeller assembly according to an exemplary embodiment of the present subject matter.

Referring now to FIG. 3, a perspective view of an impeller assembly 100 is provided according to an exemplary embodiment of the present subject matter. Impeller assembly 100 may be used in any suitable dryer appliance. For example, impeller assembly 100 may be used in dryer appliance 10, e.g., as air handler 42 (FIG. 2). Thus, impeller assembly 100 may be positioned within cabinet 12, e.g., at front duct 46, such that impeller assembly 100 draws and receives moisture laden air $A_m$ from chamber 27 of drum 26. As discussed in greater detail below, impeller assembly 100 includes features for limiting a pressure reduction or drop for a flow of air F through impeller assembly 100. Performance of dryer appliance 10 may be improved by limiting the pressure drop for the flow of air F through impeller assembly 100, as will be understood by those skilled in the art.

As may be seen in FIG. 3, impeller assembly 100 includes an impeller 110, a cover plate 120, and a housing 130. Impeller 110 is positioned within housing 130 and may be placed in mechanical communication with a motor, such as motor 28 (FIG. 2), that selectively rotates impeller 110 about an axis of rotation 152 within housing 130. For example, impeller 110 may be fixed to a shaft of motor 28 such that impeller 110 rotates about the axis of rotation 152 within housing 130 with motor 28.

Cover plate 120 is mounted to housing 130, and when cover plate 120 is mounted to housing 130, cover plate 120 may be considered as forming part of housing 130. Cover plate 120 defines an entrance 122 for receiving the flow of air F into housing 130. Housing 130 also defines an exhaust exit 136 for directing the flow of air F out of housing 130.

As an example, during operation of impeller assembly 100, impeller 110 may rotate on the axis of rotation 152 within housing 130 such that impeller 110 draws the flow of air F into housing 130 via entrance 122 of cover plate 120. In addition, impeller 110 may urge the flow of air F through housing 130 to exhaust exit 136 of housing 130 during operation of impeller assembly 100.

Figure 4:
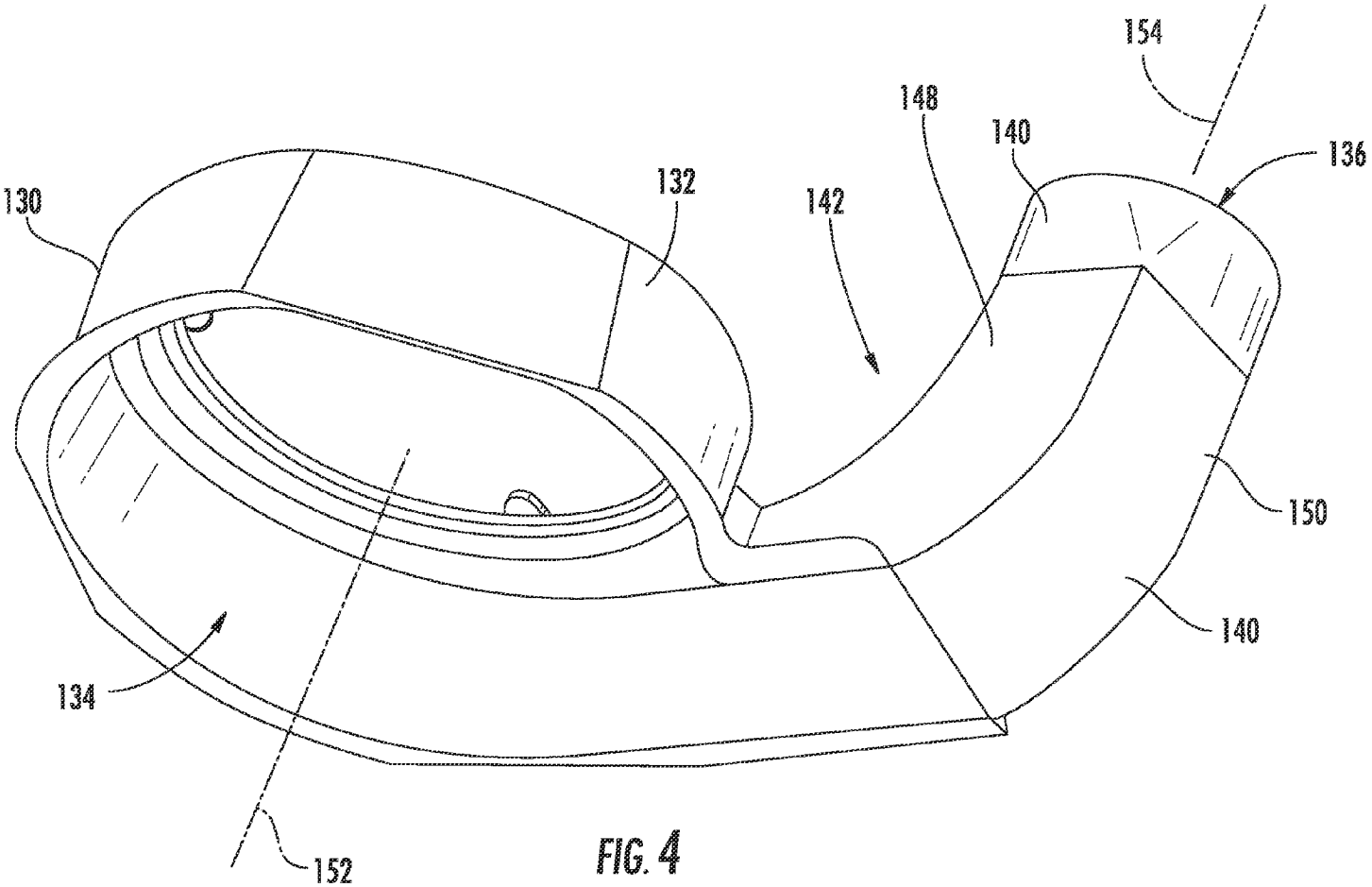
FIG. 4 provides a perspective view of a housing of the exemplary impeller assembly of FIG. 3, with a cover plate removed for clarity.
Figure 5:
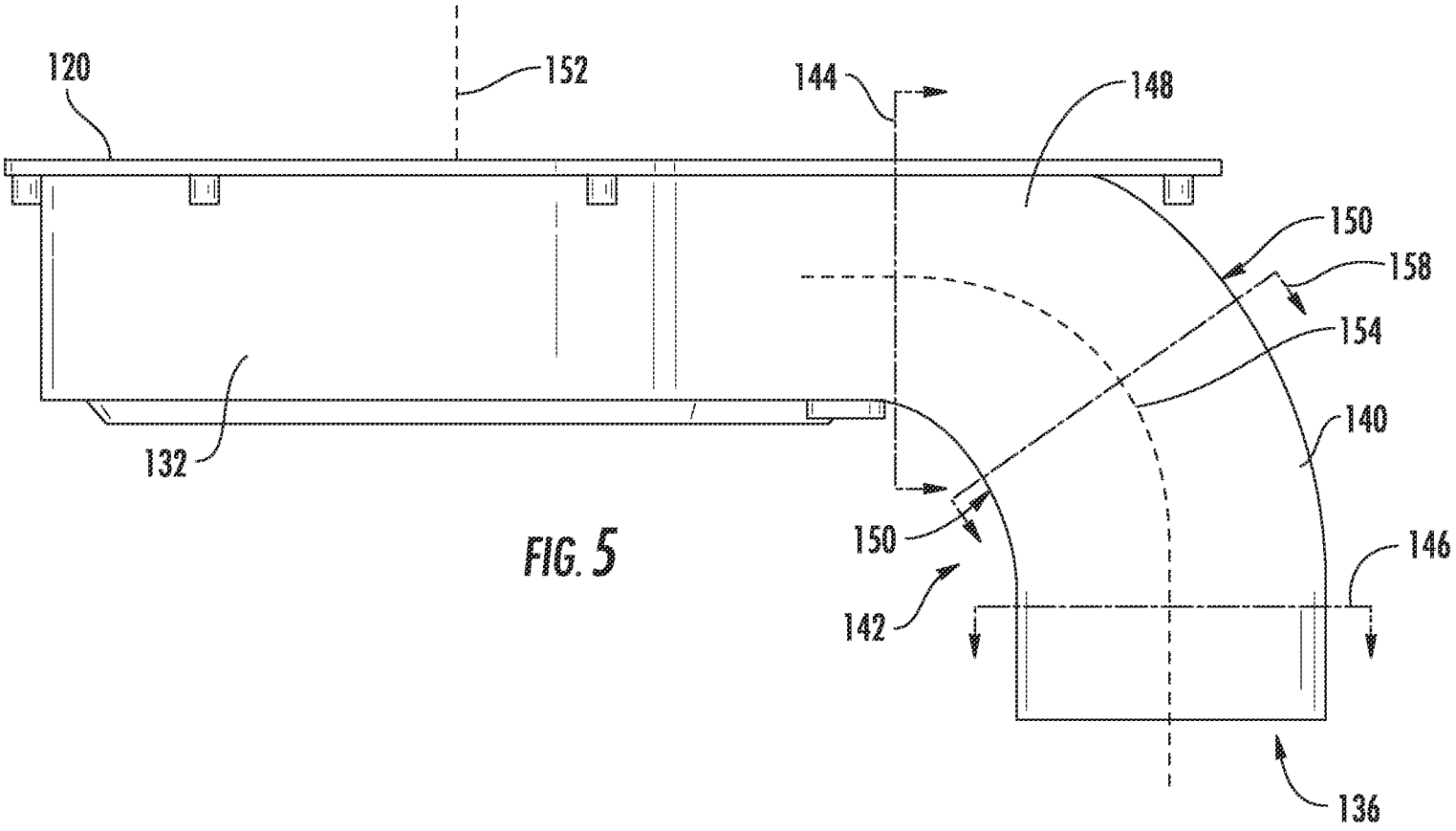
FIG. 5 provides a side view of the housing of the exemplary impeller assembly of FIG. 3, including the cover plate.

Referring now to FIGS. 4 and 5, a perspective view and side view of the exemplary housing 130 of FIG. 3 are provided. More particularly, FIG. 4 provides a perspective view of exemplary housing 130 with cover plate 120 removed for clarity, and FIG. 5 provides a side view of exemplary housing 130 including cover plate 120. As may be seen, housing 130 includes a cylindrical portion 132 and a transition duct 140. Cylindrical portion 132 defines a volute 134 of housing 130 that is sized and configured for receiving impeller 110. Thus, impeller 110 may be positioned within cylindrical portion 132, e.g., at volute 134 of cylindrical portion 132. Transition duct 140 extends between volute 134 of cylindrical portion 132 and exhaust exit 136.

Moreover, as shown, transition duct 140 defines a bend 142. For the embodiment depicted, bend 142 is an approximately ninety degree bend. For example, transition duct 140 defines a central axis 154 extending along a center thereof (FIG. 5). Upstream of bend 142, central axis 154 is approximately perpendicular to axis of rotation 152. However, downstream of bend 142, central axis 154 is approximately parallel to axis of rotation 152. Accordingly, within volute 134 of cylindrical portion 132, the flow of air F may be urged radially outward from the axis of rotation 152, e.g., along directions that are perpendicular to the axis of rotation 152. Transition duct 140 may redirect or turn the flow of air F approximately ninety degrees within housing 130, e.g., such that the flow of air F enters housing 130 and exits housing 130 along directions that are parallel to each other. More particularly, the flow of air F may enter housing 130 at entrance 122 flowing along a direction that is parallel to the axis of rotation 152, and similarly may exit housing 130 at exhaust exit 136 flowing along a direction that is also parallel to the axis of rotation 152 (see FIG. 3).

Additionally, in certain exemplary embodiments, central axis 154 defines a radius of curvature at bend 142 greater than or equal to about one half (½) of an inch and less than or equal to about six (6) inches. More specifically, in certain exemplary embodiments, central axis 154 may define a radius at bend 142 greater than or equal to about one (1) inch and less than or equal to about four (4) inches. In other exemplary embodiments, however, central axis 154 may instead define any other suitable radius of curvature at bend 142. It should be appreciated, that as used herein terms of approximation such as, "about," "substantially," and "approximately," refer to being within a ten percent margin of error. Additionally, as used herein, "radius of curvature" refers to a radius of a circle that touches the referenced curve at a given point and has the same tangent and curvature at such point.

As discussed above, housing 130 may be positioned within cabinet 12 of dryer appliance 10. As an example, housing 130 may be positioned within cabinet 12 at front duct 46. Entrance 122 of cover plate 120 may be positioned for receiving moisture laden air $A_m$ from front duct 42. In addition, cover plate 120 may be mounted to cylindrical portion 132 and positioned over volute 134 of cylindrical portion 132. Entrance 122 of cover plate 120 may also be positioned for directing the flow of air F into volute 134 of cylindrical portion 132. The flow of air F flows through housing 130 from volute 134 of cylindrical portion 132 to exhaust exit 136. From exhaust exit 136, the flow of air F exits housing 130. In dryer appliance 10, exhaust duct 48 may extend between and fluidly couple exhaust exit 136 of housing 130 and vent 49 of cabinet 12.

Housing 130 may be constructed of or with any suitable material. For example, housing 130 (not including cover plate 120) may be constructed of or with a single continuous or integral piece of plastic. In particular, cylindrical portion 132 of housing 130 and transition duct 140 of housing 130 may be constructed of a single continuous or integral piece of plastic. Cover plate 120 may also be constructed of or with any suitable material and may be mounted to cylindrical portion 132 of housing 130 in any suitable manner. For example, cover plate 120 may be constructed of a metal, such as steel.

As discussed above, transition duct 140 extends between volute 134 of cylindrical portion 132 and exhaust exit 136, and defines bend 142. Referring now particularly to FIG. 5, transition duct 140 has a first cross-section 144 positioned upstream of bend 142 and a second cross-section 146 positioned downstream of bend 142. The flow of air F may enter transition duct 140 at first cross-section 144, which may be formed at one side by cover plate 120 (see FIG. 4).

First cross-section 144 and second cross-section 146 of transition duct 140 each define a substantially rectilinear shape. More particularly, first cross-section 144 and second cross-section 146 of transition duct 140 each define a shape made up of a plurality of substantially linear sidewalls 148 and substantially linear top and bottom walls 150. Accordingly, as used herein, the term substantially "rectilinear shape" refers to a polygon shape defining substantially straight walls.

Figure 6:
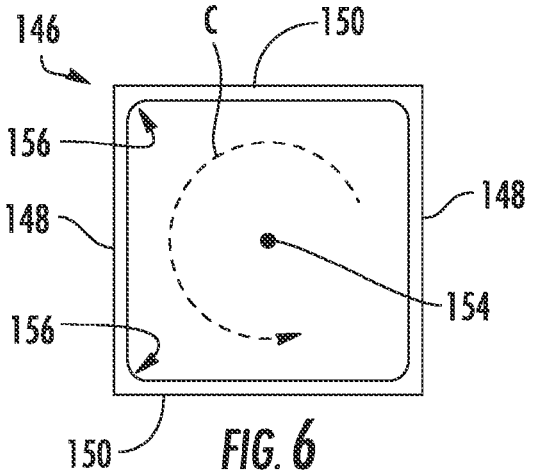
FIG. 6 provides a cross-sectional view of a transition member in accordance with an exemplary embodiment of the present disclosure.

Referring now also to FIG. 6, an exemplary embodiment of second cross-section 146 is provided. As shown, second cross-section 146 defines a plurality of interior corners 156 where sidewalls 148 meet top and bottom walls 150. Each of the interior corners 156 defines a radius of curvature less than or equal to about one (1) inch. However, in other embodiments, each of the interior corners 156 may define a radius of curvature less than or equal to about three quarters (¾) of an inch, less than or equal to about one half (½) of an inch, or less than or equal to about one quarter (¼) of an inch. In still other embodiments, however, any other suitable radius of curvature may be provided for the interior corners 156.

Figure 7:
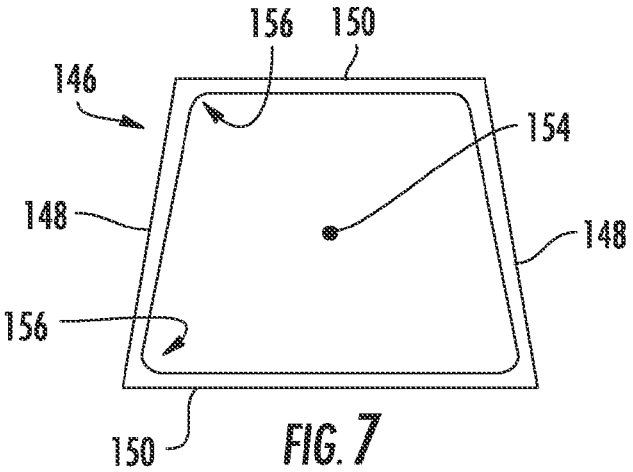
FIG. 7 provides a cross-sectional view of a transition member in accordance with another exemplary embodiment of the present disclosure.
Figure 8:
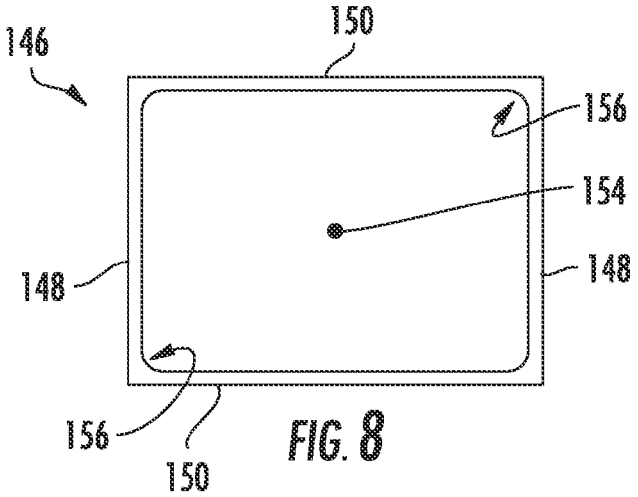
FIG. 8 provides a cross-sectional view of a transition member in accordance with yet another exemplary embodiment of the present disclosure.

For the embodiment of FIG. 6, second cross-section 146 is depicted as defining a squared shape. However, in other exemplary embodiments, second cross-section 146 may instead define any other suitable rectilinear shape. For example, as is depicted in FIG. 7, second cross-section 146 may instead define a trapezoidal shape. Alternatively still, as is depicted in FIG. 8, second cross-section 146 may instead define a rectangular shape. Notably, in certain embodiments, inner corners 156 of second cross-section 146 may each define the same radius of curvature. For example, for the embodiments of FIGS. 6 and 8, each of the corners 156 are depicted defining the same radius of curvature. By contrast, however, for the embodiment of FIG. 7, certain of the corners 156 are depicted defining different radii of curvature than the rest of the corners 156.

Moreover, first cross-section 144 may be configured in substantially the same manner as second cross-section 146. Accordingly, each of first cross-section 144 and second cross-section 146 may define interior corners 156 in accordance with the above description, e.g., each defining radius of curvature less than or equal to about one inch. Additionally, first cross-section 144 may also define any suitable rectilinear shape, such as the squared shape depicted in FIG. 6, the trapezoidal shape depicted in FIG. 7, or the rectangular shape depicted in FIG. 8. In certain exemplary embodiments, first cross-section 144 may be the same size and shape as second cross-section 144. For example, in certain embodiments, transition duct 140 may define a substantially constant cross-section between first cross-section 144 and second cross-section 146. More particularly, referring specifically to FIGS. 4 and 5, transition duct 140 may define a substantially constant cross-sectional shape throughout bend 142. By way of example, transition duct 140 may define a third cross-section 158 (FIG. 5) positioned in bend 142, i.e., between first cross-section 144 and second cross-section 146, that defines a shape and interior corners that are substantially the same as first cross-section 144 and/or second cross-section 146.

An impeller assembly 100 including cover plate 120 and housing 130 of the present disclosure may allow for a decrease in pressure loss (and thus an increased change in pressure) from entrance 122 of cover plate 120 to exhaust exit 136 of housing 120. More particularly, such configuration may prevent an amount of circumferential swirl in the flow of air F about central axis 154 as the flow of air F travels through bend 142. Such is unexpectedly achieved by reducing the aerodynamics of transition member 140 through bend 142 in a circumferential direction C, i.e., about centerline 154 (see FIG. 6). More particularly, by configuring the bend 142 to deter swirling of the flow of air F in the circumferential direction C about centerline 154, the flow of air F is instead urged longitudinally along the centerline 154, reducing unnecessary loss of kinetic energy in the flow of air F and increasing useful work from the impeller assembly 100. Thus, an efficiency of drier appliance 10 may be improved with impeller assembly 100. In particular, the efficiency of drier appliance 10 may be improved without increasing the size of impeller 110 and/or increasing the speed of impeller 110.

Notably, transition member 140 may, in certain embodiments, define a substantially circular cross-sectional shape at exhaust exit 136 having a diameter of, e.g., about four inches. Transition member 120 may gradually change from second cross-section 146 defining a rectilinear shape to the circular shape of the cross-section at exhaust exit 136. Such a configuration may allow for transition member 140 to be easily connected with, e.g., exhaust duct 48. Alternatively, however, transition member 140 may define a cross-sectional shape at exhaust exit 136 similar to second cross-section 146. In such an embodiment, a separate adapter (not shown) may be provided to fit over exhaust exit 136 and attach to, e.g., exhaust duct 48.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A housing for an impeller of a dryer appliance, comprising:

a cylindrical portion configured for receiving the impeller, the cylindrical portion having a volute, the impeller configured for providing an airflow through at least a portion of the dryer appliance; and a transition duct extending between the volute and an exhaust exit, the transition duct defining a bend and having a first cross-section and a second cross-section, the first cross-section positioned upstream of the bend at a first substantially straight portion of the transition duct and the second cross-section positioned downstream of the bend at a second substantially straight portion of the transition duct, the first cross-section and the second cross-section each defining a substantially rectilinear shape, the substantially rectilinear shapes defined by the first and second cross-sections each being a polygon shape having a plurality of substantially straight walls.

2. The housing of claim 1, wherein the first cross-section and the second cross-section each define a plurality of interior corners, each of the interior corners defining a radius of curvature less than about one inch.

3. The housing of claim 1, wherein the bend is an approximately ninety degree bend.

4. The housing of claim 3, wherein the transition duct defines a central axis, and wherein the central axis defines a radius at the bend greater than about one half of an inch and less than about six inches.

5. The housing of claim 1, wherein the first cross-section and the second cross-section each define a rectangular shape or a square shape.

6. The housing of claim 1, wherein the first cross-section and the second cross-section each define a trapezoidal shape.

7. The housing of claim 1, wherein the transition duct defines a substantially constant cross-section between the first cross-section and the second cross-section.

8. The housing of claim 1, further comprising a cover plate mounted to the cylindrical portion and positioned over the volute of the cylindrical portion and the inlet cross-section of the transition duct.

9. The housing of claim 8, wherein the cover plate defines an entrance for receiving the flow of air into the volute of the cylindrical portion.

10. The housing of claim 1, wherein the impeller is configured for rotating on an axis of rotation, wherein the transition duct defines a central axis, and wherein the central axis of the transition duct at the exhaust exit is substantially parallel to the axis of rotation.

* * * * *